US010756485B2

(12) United States Patent
Ohfuku et al.

(10) Patent No.: US 10,756,485 B2
(45) Date of Patent: Aug. 25, 2020

(54) CONNECTOR HAVING A LOCKING PORTION, AN UNLOCKING PORTION AND A FITTING ASSURANCE MEMBER

(71) Applicant: YAZAKI CORPORATION, Tokyo (JP)

(72) Inventors: Ryosuke Ohfuku, Makinohara (JP); Takahiro Ohmoto, Wako (JP); Masaru Shinmura, Wako (JP); Yu Saito, Wako (JP); Yuki Goto, Wako (JP); Takashi Endo, Wako (JP); Kazuyuki Iwashita, Wako (JP); Akihiro Tsuruta, Fujieda (JP); Shinji Kodama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/804,007

(22) Filed: Feb. 28, 2020

(65) Prior Publication Data

US 2020/0203890 A1 Jun. 25, 2020

Related U.S. Application Data

(63) Continuation of application No. PCT/JP2018/032328, filed on Aug. 31, 2018.

(30) Foreign Application Priority Data

Aug. 31, 2017 (JP) ..... 2017-168019

(51) Int. Cl.
*H01R 13/627* (2006.01)
*H01R 13/436* (2006.01)

(52) U.S. Cl.
CPC ..... *H01R 13/6275* (2013.01); *H01R 13/4362* (2013.01); *H01R 13/6272* (2013.01)

(58) Field of Classification Search
CPC ..... H01R 13/6271; H01R 13/6275
(Continued)

(56) References Cited

U.S. PATENT DOCUMENTS

2004/0142594 A1 7/2004 Endo
2013/0210266 A1 8/2013 Osada et al.
(Continued)

FOREIGN PATENT DOCUMENTS

JP 2004-220970 A 8/2004
JP 2012-64461 A 3/2012
JP 2017-111910 A 6/2017

*Primary Examiner* — Phuong K Dinh
(74) *Attorney, Agent, or Firm* — Kenealy Vaidya LLP

(57) ABSTRACT

A connector includes a housing; and a fitting assurance member slidably attached to an outer side of the housing. The housing has a locking portion to be locked to the locked portion during a movement of the housing in a fitting direction to the counterpart housing. The fitting assurance member slides and moves relatively to the housing in the fitting direction from a temporary locking position to a formal locking position. The housing has an unlocking operation portion to apply unlocking force to the locking portion. The fitting assurance member has a pair of side walls on the outer side of the housing and a coupling portion connecting end portions of the pair of side walls. The coupling portion is located between the unlocking operation portion and the housing and separated from the unlocking operation portion.

2 Claims, 24 Drawing Sheets

(58) Field of Classification Search
USPC ..... 439/352, 607.01
See application file for complete search history.

(56) References Cited

U.S. PATENT DOCUMENTS

| | | | | |
|---|---|---|---|---|
| 2015/0090927 | A1* | 4/2015 | Park | C01G 53/54<br>252/182.1 |
| 2016/0164224 | A1* | 6/2016 | Sekino | H01R 13/6272<br>439/352 |
| 2017/0170602 | A1 | 6/2017 | Matsumoto et al. | |

* cited by examiner

CONNECTOR HAVING A LOCKING PORTION, AN UNLOCKING PORTION AND A FITTING ASSURANCE MEMBER

CROSS-REFERENCE TO RELATED APPLICATIONS

This is a continuation of International Application No. PCT/JP2018/032328 filed on Aug. 31, 2018, and claims priority from Japanese Patent Application No. 2017-168019 filed on Aug. 31, 2017, the entire content of which is incorporated herein by reference.

BACKGROUND

The present invention relates to a connector.

There is a connector formed by fitting a pair of housings to each other. When one of the housings for forming the connector is inserted up to a fitting position where the one housing can be fitted to the other housing, terminals received in the respective housings are electrically connected to each other, and the housings are locked to each other. Since such fitting work for this type of connector is performed manually, there is however a fear of terminating the fitting work without noticing a half-fitted (non-locked) state in which the one housing has not been inserted up to the regular fitting position yet, so that the housing may be unlocked later.

To solve this problem, a connector provided with a fitting position assurance lock has been proposed in order to prevent such half-fitting of a housing (see PTL 1).

The connector according to PTL 1 is provided with a cylindrical female housing in which female terminals are received, a cylindrical male housing in which male terminals are received and which is fitted to the female housing, a cylindrical fitting assurance member which is mounted slidably on an outer side of the female housing, a female lock which is supported like a cantilever on the female housing and which extends toward the male housing, a fitting assurance lock which is supported like a cantilever on the fitting assurance member and which extends toward the male housing, and a locking protrusion which protrudes from an outer face of the male housing so as to lock the female lock and the fitting assurance lock to each other.

When the male housing is inserted into the female housing on which the fitting assurance member is mounted in such a configuration, first, a locking portion of the female lock climbs over the locking protrusion so as to be locked to the locking protrusion. Successively, a locking claw of the fitting assurance lock climbs over the locking protrusion and the locking portion of the female lock so as to be locked to the locking protrusion through the locking portion of the female lock. Thus, the fitting assurance lock is locked to the locking protrusion through the female lock so that fitting between the housings is assured.

In addition, an unlocking operation portion for unlocking the female lock is provided in the female housing according to PTL 1. The unlocking operation portion is disposed on an opposite side to the male connector in a fitting direction (a rear side in the fitting direction) to be separated outward from the female housing. When the fitting assurance member is pulled toward a direction (an opposite direction to the fitting direction) to be separated from the male housing in a state in which the fitting assurance lock has been locked to the locking protrusion through the female lock (a state in which the fitting assurance member has been set at a final locking position), the locking claw of the fitting assurance lock climbs over the locking portion of the female lock so as to ride onto the locking protrusion (the fitting assurance member moves from the final locking position to a temporary locking position). Successively, when the unlocking operation portion is pushed down toward the female housing and the fitting assurance member is pulled in the opposite direction to the fitting direction, the locking portion of the female lock rides onto the locking protrusion, and the locking claw of the fitting assurance lock and the locking portion of the female lock sequentially climb over the locking protrusion. As a result, the female housing is removed from the male housing.

As for details of the above protector, refer to PTL 1, JP-A-2012-64461.

SUMMARY

In the connector according to PTL 1, an excessive displacement prevention portion abutting against the unlocking operation portion to regulate a maximum displacement thereof may be provided in the female housing in order to prevent excessive displacement of the unlocking operation portion. In addition, a pair of side walls of the fitting assurance member opposed to each other on the outer side of the housing may be coupled to each other by a coupling portion in order to secure rigidity of the fitting assurance member.

Thus, when the excessive displacement prevention portion is provided in the female housing and the coupling portion is provided in the fitting assurance member, the coupling portion has to be disposed on an outer side of the excessive displacement prevention portion so as to prevent the excessive displacement prevention portion and the coupling portion from interfering with each other in a connector using state in which the fitting assurance member has been set at the final locking position. This leads to an increase in the size of the connector.

An object of the present invention is to provide a connector in which excessive displacement of an unlocking operation portion can be prevented, rigidity of a fitting assurance member can be secured, and an increase in the size of the connector in a connector using state can be suppressed.

Embodiments of a connector according to the present invention provide the following item (1) and (2).

(1) A connector comprising:

a housing; and a fitting assurance member slidably attached to an outer side of the housing to enable a sliding movement, the housing having a locking portion being elastically deformed in an opposite direction to a locking direction to climb over a locked portion of a counterpart housing and elastically restored in the locking direction to be locked to the locked portion upon a movement of the housing in a fitting direction to the counterpart housing, the fitting assurance member sliding and moving relatively to the housing in the fitting direction from a temporary locking position to a formal locking position to be locked to the counterpart housing upon the locking portion being locked to the locked portion to achieve a connector fitting state, the housing having an unlocking operation portion to be separated outward from an opposite fitting side of the housing, the unlocking operation portion being pushed down in an unlocking operation direction toward the housing to apply unlocking force to the locking portion in the opposite direction, the unlocking operation portion being pushed down in the unlocking operation direction upon the fitting assurance member being positioned at the temporary locking position to release the connector fitting state, the fitting assurance member having a pair of side walls opposed to each other on the outer side of the housing and a coupling portion connecting end portions of the pair of side walls on the opposite fitting side each other, the coupling portion being located between the unlocking operation portion and the housing and separated from the unlocking operation portion upon the fitting assurance member being positioned at the temporary locking position, the coupling portion being configured to allow contact to the unlocking operation portion upon the unlocking operation portion being pushed down and displaced in the unlocking operation direction.

According to a first aspect of the invention, relating to the item (1), rigidity of the fitting assurance member can be secured by the coupling portion which couples the end portions of the pair of side walls on the opposite side to the fitting side (the opposite side in the fitting direction) to each other. In addition, the coupling portion of the fitting assurance member positioned at the temporary locking position can be set at a position to abut against the unlocking operation portion within a range in which displacement of the unlocking operation portion in the unlocking operation direction cannot be excessive, so that the excessive displacement of the unlocking operation portion can be prevented by the coupling portion. Further, in a connector using state, the fitting assurance member is set at the final locking position to which the fitting assurance member has moved in the fitting direction from the temporary locking position Accordingly, a portion or the whole of the coupling portion can be disposed more closely to the fitting side than a distal end of the unlocking operation portion on an opposite side to the fitting side so that an increase in the whole size of the connector in the connector using state can be suppressed.

Accordingly, the excessive displacement of the unlocking operation portion can be prevented, the rigidity of the fitting assurance member can be secured, and the increase in the size of the connector in the connector using state in which the fitting assurance member has been set at the final locking position can be suppressed.

(2) The connector according to the item (1), wherein the coupling portion of the fitting assurance member positioned at the temporary locking position contacts to the housing to restrict a tilt of the housing with respect to the fitting assurance member.

According to a second aspect of the invention, relating to the item (2), in the connector using state in which the fitting assurance member is set at the final locking position, the tilt of the housing with respect to the fitting assurance member is restricted by the coupling portion. Accordingly, a connection state between terminals received in the housing and counterpart terminals received in the counterpart housing can be stabilized.

According to the present invention, it is possible to prevent the excessive displacement of the unlocking operation portion, secure the rigidity of the fitting assurance member, and suppress the increase in the size of the connector in the connector using state.

DETAILED DESCRIPTION

Figure 1:
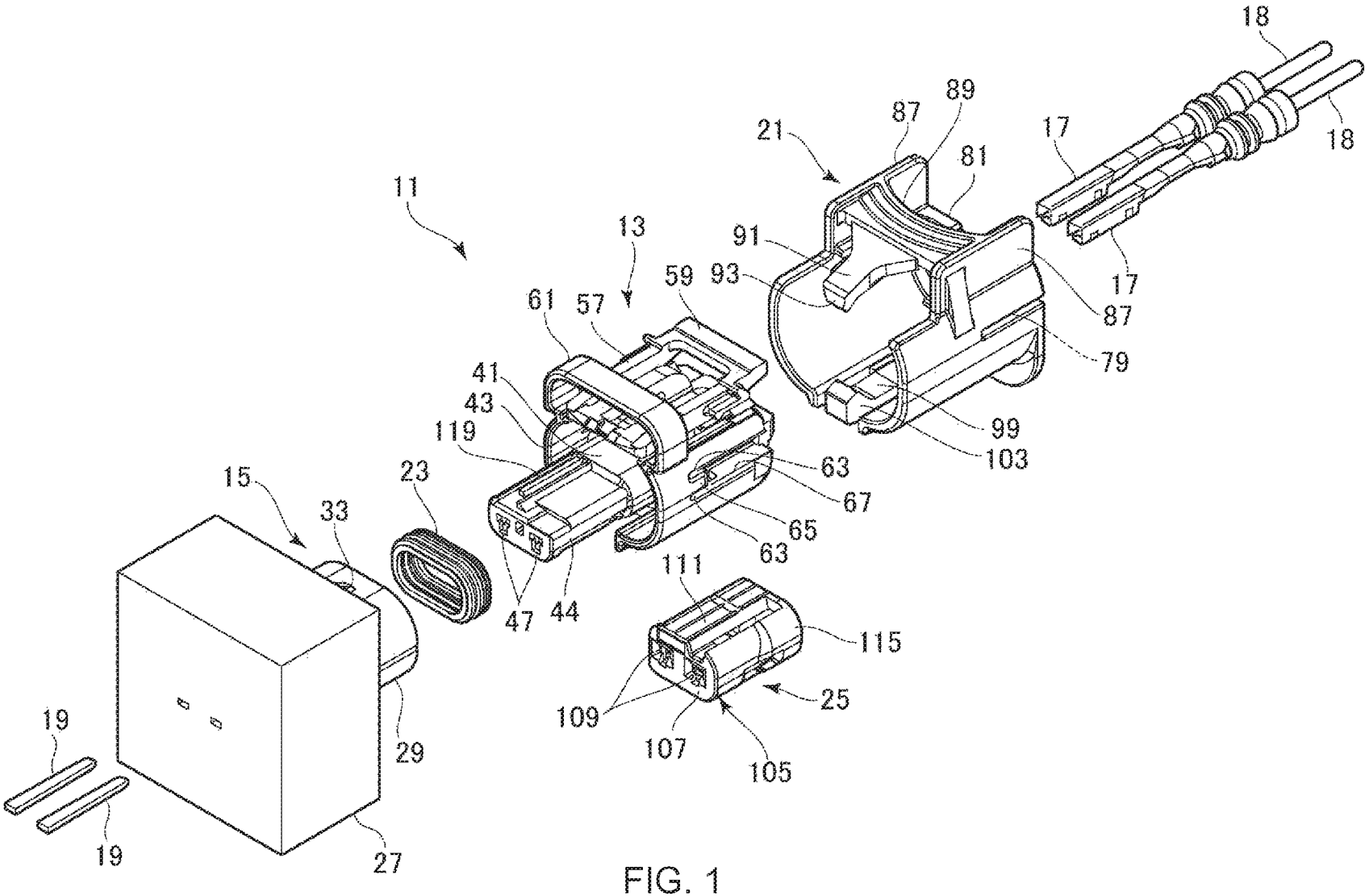
FIG. 1 is an exploded perspective view of a connector according to an embodiment of the present invention.
Figure 2:
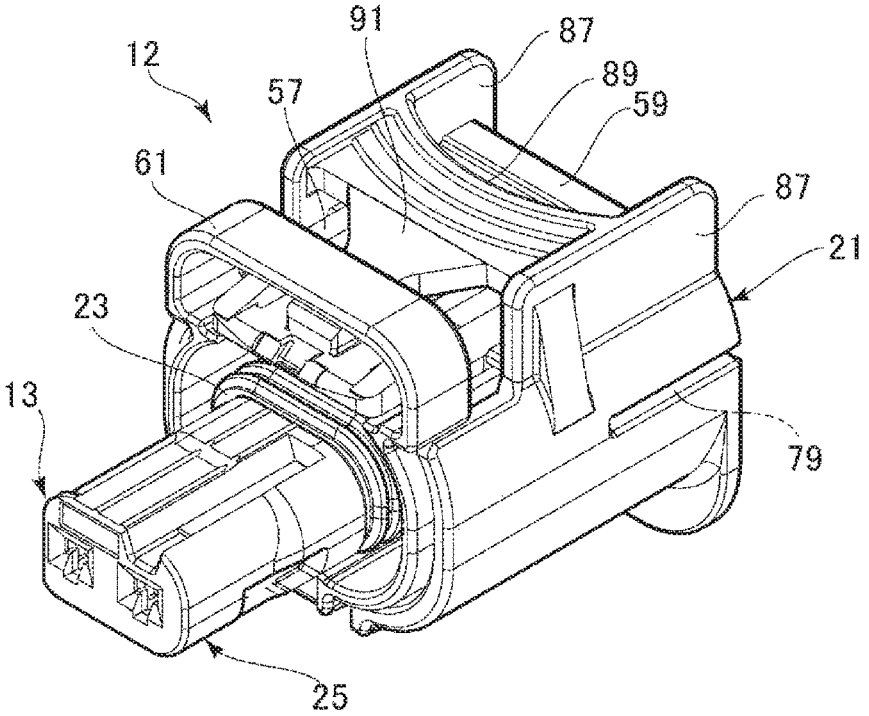
FIG. 2 is a perspective view of the external appearance of a female connector unit.
Figure 3:
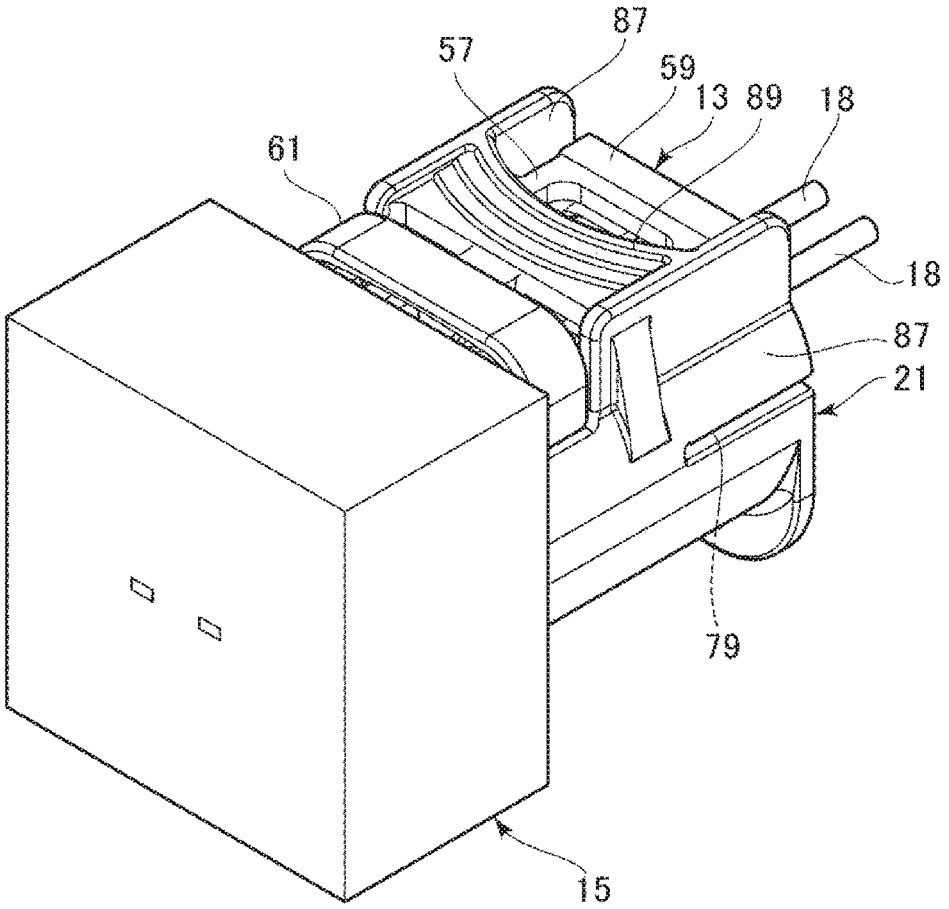
FIG. 3 is a perspective view of the external appearance of a CPA final locking state.

An embodiment of a connector for carrying out the present invention will be described below with reference to the drawings. FIG. 1 is an exploded perspective view of a connector 11 according to the present embodiment. FIG. 2 is a perspective view of the external appearance of a female connector unit 12 in which a CPA 21, a seal member 23 and a side retainer 25 have been mounted on a female housing 13. FIG. 3 is a perspective view of the external appearance of a connector fitting state. FIG. 4 to FIG. 8 are longitudinal sectional views showing movement between prior to connector fitting and CPA final locking. Incidentally, a direction of fitting to a counterpart connector will be hereinafter described as frontward (frontward in the fitting direction); a direction of separation from the counterpart connector, rearward (rearward in the fitting direction); one side (upper side in FIG. 4) in a connector height direction (height direction) substantially orthogonally intersecting the fitting direction, up; the other side (lower side in FIG. 4) in the connector height direction, down; and a connector width direction (width direction) substantially orthogonally intersecting the fitting direction and the connector height direction, left/right direction.

(Schematic Configuration of Connector 11)

As shown in FIG. 1, the connector 11 is configured to include the cylindrical female housing (housing) 13, a cylindrical male housing (counterpart housing) 15, female terminals 17, male terminals 19, the cylindrical CPA (fitting assurance member) 21, the annular seal member 23, and the side retainer 25. The female terminals 17 are received in the female housing 13. The male terminals 19 are received in the male housing 15. The cylindrical CPA 21 is mounted on an outer face of the female housing 13 so as to be slidable in the fitting direction. The annular seal member 23 is mounted on the female housing 13. The side retainer 25 is mounted on the female housing 13. The female housing 13, the CPA 21, the seal member 23, and the side retainer 25 constitute the female connector unit 12. The connector 11 according to the present embodiment connects two pairs of the female terminals 17 and the male terminals 19 to each other. The two female terminals 17 are received in the female housing 13, and the two male terminals 19 are received in the male housing 15. Incidentally, the housing and the counterpart housing may be used as the male housing and the female housing reversely to the present embodiment.

(Male Housing 15)

Figure 4:
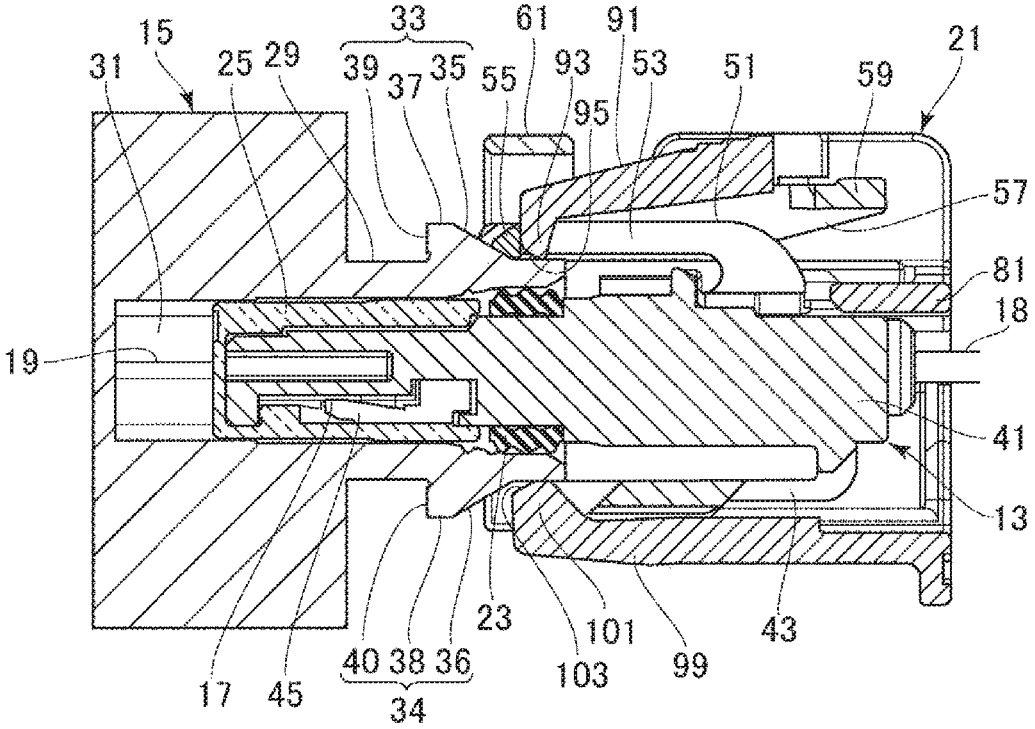
FIG. 4 is a longitudinal sectional view prior to connector fitting.

The male housing 15 which is made of a synthetic resin is, for example, directly linked to a device wall of a not-shown electrical device which has been installed in a vehicle etc. As shown in FIG. 1, the male housing 15 has a proximal end portion 27 corresponding to the device wall, and a circularly cylindrical hood portion 29 extending in the fitting direction from the proximal end portion 27. As shown in FIG. 4, a bottomed space 31 having an inner circumferential face axially continuous to an inner circumferential face of the hood portion 29 is formed in the proximal end portion 27. The male terminals 19 shaped like tabs and protruding toward the fitting direction are fixed to a deep side of the space 31.

An upper locking protrusion (locked portion) 33 is provided protrusively on an upper face of an outer circumference of the hood portion 29. As shown in FIG. 4, the upper locking protrusion 33 has an upper inclined face 35, an upper flat face 37, and an upper locking face 39. The upper inclined face 35 has a protruding height increasing toward the rear. The upper flat face 37 is connected to an upper end (rear end) of the upper inclined face 35 and extends along the front/rear direction. The upper locking face 39 is connected to a rear end of the upper flat face 37 and rises substantially perpendicularly thereto. The upper flat face 37 has a width-direction length set to be longer and a front/rear-direction length set to be shorter than the upper inclined face 35. In a similar manner or the same manner, a lower locking protrusion 34 is protrusively provided on a lower face of the outer circumference of the hood portion 29. The lower locking protrusion 34 has a lower inclined face (another inclined face) 36 and a lower flat face 38. The lower inclined face 36 has a protruding height increasing toward the rear. The lower flat face 38 is connected to a lower end (rear end) of the lower inclined face 36 and extends along the front/rear direction. The lower flat face 38 has a width-direction length set to be longer and a front/rear-direction length set to be shorter than the lower inclined face 36. The upper locking protrusion 33 and the lower locking protrusion 34 are formed to be substantially vertically symmetric to each other. The upper inclined face 35 and the lower inclined face 36 are disposed in substantially the same range in the fitting direction. The upper flat face 37 and the lower flat face 38 are disposed in substantially the same range in the fitting direction.

(Female Housing 13)

As shown in FIG. 4, the female housing 13 which is made of a synthetic resin is formed to include a cylindrical inner housing 41 and a cylindrical outer housing 43. The outer housing 43 is put to surround an outer circumferential face of the inner housing 41 at a gap from the outer circumference face. The hood portion 29 of the male housing 15 is inserted into the gap between the outer circumferential face of the inner housing 41 and an inner circumferential face of the outer housing 43.

Two female terminal reception chambers 45 into which the female terminals 17 are inserted from the rear are formed in the inner housing 41. The female terminal reception chambers 45 are opened to the outside through insertion ports 47 (see FIG. 1) formed in a distal end portion of the inner housing 41, and the tab-shaped male terminals 19 are inserted into the female terminal reception chambers 45 from the insertion ports 47.

The inner housing 41 is formed to overhang frontward from a front end face of the outer housing 43. The seal member 23 is mounted on the circularly cylindrical outer circumferential face of the inner housing 41 surrounded by the outer housing 43. The side retainer 25 is mounted on an outer circumferential face of a rectangularly cylindrical inner housing front portion 44 overhanging frontward from the outer housing 43.

An elastically deformable housing arm 51 is formed on an outer circumferential face of the female housing 13. The housing arm 51 is formed into a gate shape. The housing arm 51 has a pair of left and right elastic arm pieces 53 and a locking piece (locking portion) 55. Each of the elastic arm pieces 53 is supported like a cantilever on the outer circumferential face of the female housing 13 (the inner housing 41). The elastic arm pieces 53 extend toward the male housing 15 and substantially in parallel with the outer circumferential face of the inner housing 41. The locking piece 55 bridges front end portions of the elastic arm pieces 53 in the width direction. The locking piece 55 is locked to the upper locking protrusion 33 of the male housing 15 when the two housings 13 and 15 are fitted to each other.

With a rear end portion of the housing arm 51 used as a fulcrum, the locking piece 55 of the housing arm 51 can swing upward (outward) and be elastically deformed (deflected). In the housing arm 51, a gate-shaped locking arm 57 is continuously provided so as to extend rearward and be supported by the front end portions of the paired elastic arm pieces 53 like a cantilever. The locking arm 57 has an unlocking operation portion 59 which is pushed down to the unlocking operation direction, toward the female housing 13 (the inner housing 41) when the locking state of the housing arm 51 is released. The unlocking operation portion 59 is separated outward (upward) from a rear portion (opposite to the fitting side) of the female housing 13 (the inner housing 41) and is disposed at a higher position than the elastic arm pieces 53. When the unlocking operation portion 59 is pushed down in the unlocking operation direction, this causes upward unlocking force (in the opposite direction to the locking direction) to be given to the locking piece 55 through the locking arm 57.

The female housing 13 has a female housing bridge 61. The female housing bridge 61 rises up from opposite, left and right ends of an upper portion of the front end of the outer housing 43, crosses the upper portion in the width direction, and covers the locking piece 55 from the outside (upper side). The female housing bridge 61 is disposed at a position where the female housing bridge 61 allows elastic deformation of the locking piece 55 caused by the upper inclined face 35 of the male housing 15, outside (upper side) and near the movable range of the locking piece 55.

Figure 15:
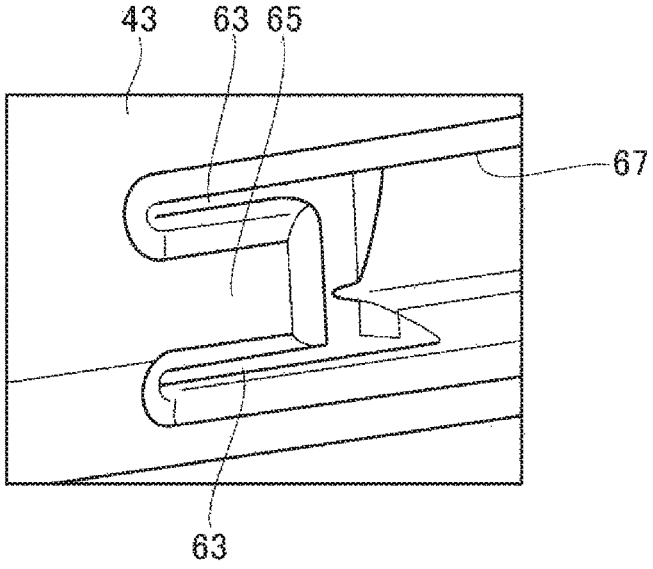
FIG. 15 is an enlarged view of a side lock.

As shown in FIG. 1 and FIG. 15, the female housing 13 has a pair of left and right side locks 65. Each of the left and right side locks 65 is formed as a portion of a corresponding one of left and right side walls of the outer housing 43 notched by a pair of upper and lower slits 63. The side lock 65 is supported like a cantilever by the outer housing 43 so that a front end of the side lock 65 continues to the corresponding side wall of the outer housing 43 while a rear end of the side lock 65 is a free end. Each side lock 65 is positioned at a front end portion of one of the pair of guide grooves 67. The guide grooves 67 extend in the front/rear direction on left and right sides of the outer housing 43. The upper and lower slits 63 extend frontward from the guide groove 67.

(Side Retainer 25)

Figure 20:
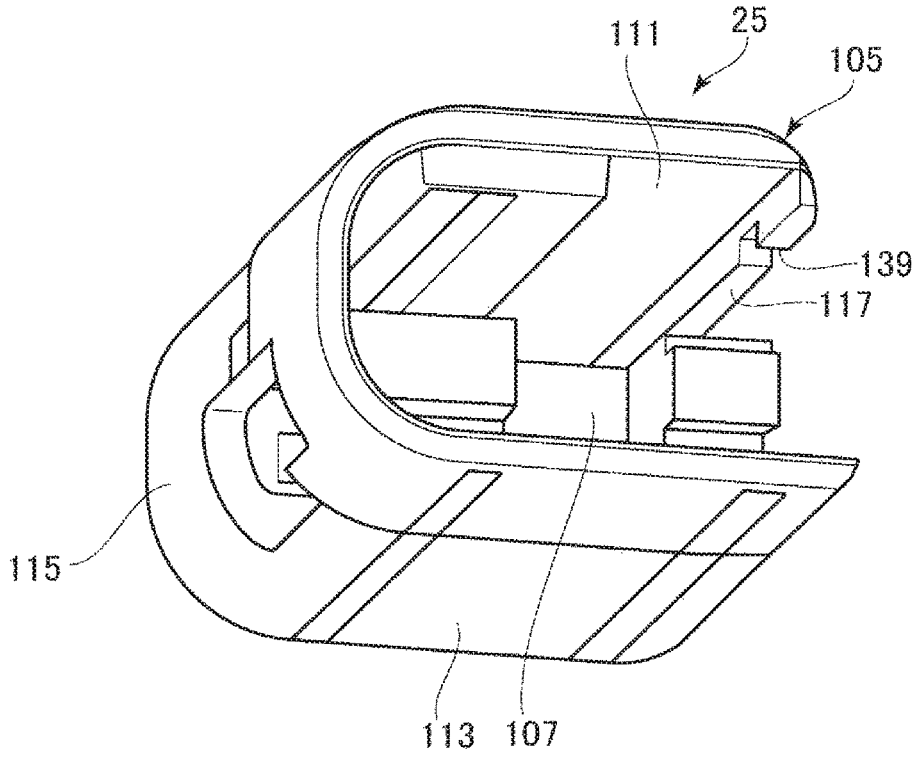
FIG. 20 is a perspective view of a side retainer.

The side retainer 25 is made of a synthetic resin. As shown in FIG. 1 and FIG. 20, the side retainer 25 has a retainer body 105 and a retainer front plate portion 107. The retainer body 105 has a U-shaped section opened on one side in the width (side) direction. The retainer front plate portion 107 covers a front end of the retainer body. Two insertion ports 109 are formed in the retainer front plate portion 107. In a state in which the side retainer 25 has been set at a final locking position which will be described later, the insertion ports 109 communicate with the insertion ports 47 of the inner housing 41 so that the male terminals 19 can be inserted from the insertion ports 47 and 109.

The retainer body 105 is provided with a retainer upper face portion 111, a retainer lower face portion 113, and a retainer curved face portion 115. The retainer upper face portion 111 and the retainer lower face portion 113 are opposed to each other while being separated from each other vertically. An edge of the retainer upper face portion 111 and an edge of the retainer lower face portion 113 connect to each other through the retainer curved face portion 115. A retainer protrusion 117 extending linearly along the fitting direction is provided on an opening side edge of the retainer upper face portion 111 to protrude downward. A notch 139 is formed in a rear end portion of the retainer protrusion 117. A jig 149 (see FIG. 22) used for moving the side retainer 25 from the final locking position which will be described later to a temporary locking position is inserted into the notch 139.

Figure 19:
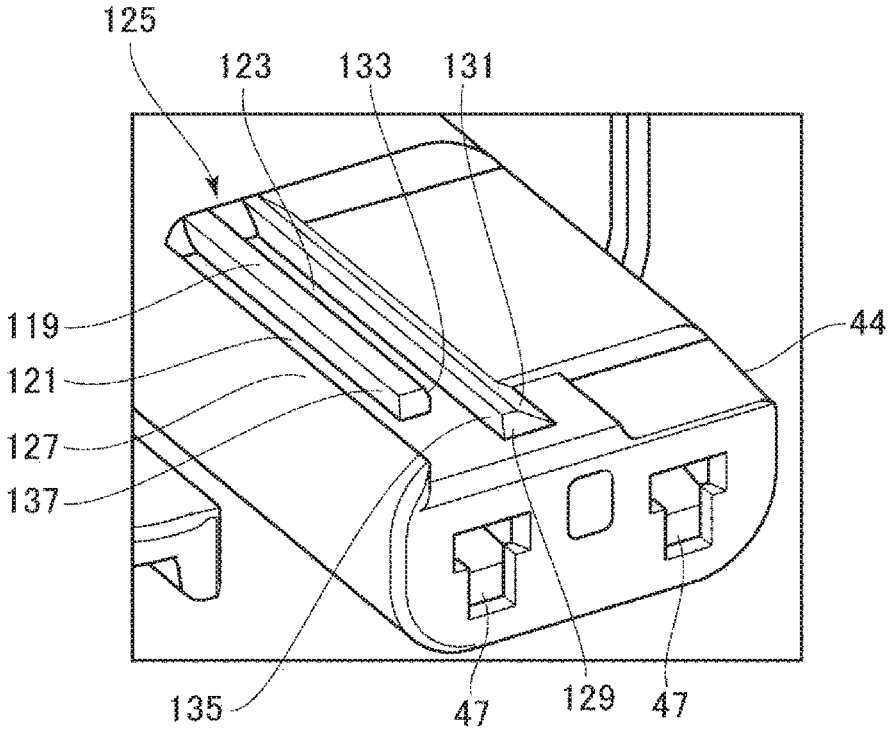
FIG. 19 is a perspective view of an inner housing front portion.

As shown in FIG. 19, a locking groove group 125 including a final locking groove 121 and a temporary locking groove 123 which are arranged side by side with a partition wall 119 interposed therebetween is provided on an upper face of the inner housing front portion 44. The partition wall 119, the final locking groove 121, and the temporary locking groove 123 extend linearly along the fitting direction. The final locking groove 121 is sectioned between a side wall upper end portion 127 of the inner housing front portion 44 and the partition wall 119. The side wall upper end portion 127 protrudes from the upper face of the inner housing front portion 44. The temporary locking groove 123 is sectioned between a groove formation protrusion 129 and the partition wall 119. The groove formation protrusion 129 protrudes from the upper face of the inner housing front portion 44.

Figure 21A:
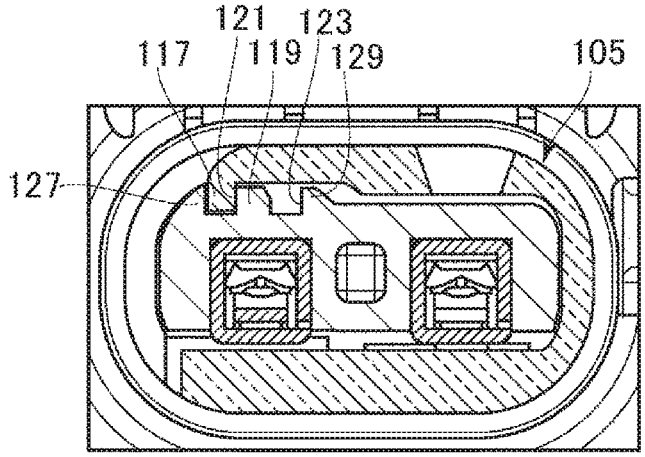
FIGS. 21A and 21B are longitudinal sectional views of the inner housing front portion and the side retainer, FIG. 21A showing a final locking position, FIG. 21B showing a temporary locking position.
Figure 21B:
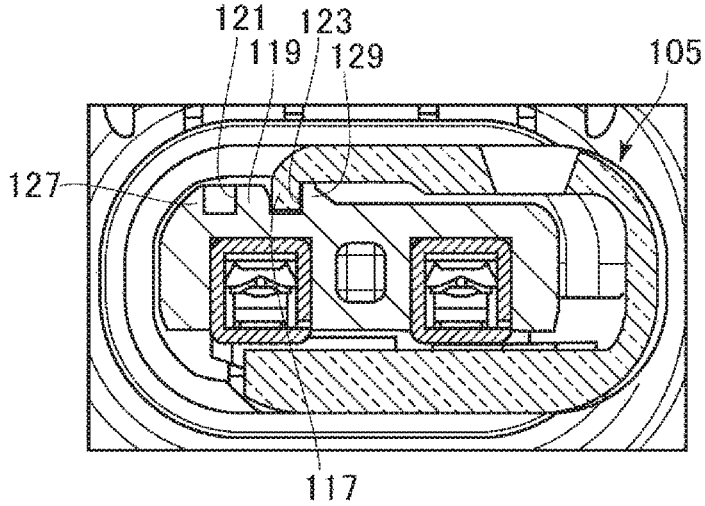

When the side retainer 25 is mounted onto the inner housing front portion 44, the opening on one side of the side retainer 25 is slightly widened so that the inner housing front portion 44 can be inserted into the side retainer 25 from the opening and moved in the width direction (mounting direction). When the side retainer 25 is moved in the mounting direction, the retainer protrusion 117 enters the temporary locking groove 123 to be locked thereto (temporary locking position), as shown in FIG. 21B. When the side retainer 25 is further moved in the mounting direction, the retainer protrusion 117 enters the final locking groove 121 to be locked thereto (final locking position), as shown in FIG. 21A.

A side face of the groove formation protrusion 129 outside the groove is a first inclined face 131 which is gentle. When the side retainer 25 is pushed in the mounting direction, the retainer protrusion 117 slides on the first inclined face 131 comparatively easily so that the side retainer 25 can climb over the groove formation protrusion 129 while bending. As a result, the side retainer 25 is mounted at the temporary locking position. A side face of the partition wall 119 on the temporary locking groove 123 side is a second inclined face 133 which is slightly steeper than the first inclined face 131. By pressing the side retainer 25 more strongly than when the side retainer 25 is mounted at the temporary locking position, the retainer protrusion 117 slides on the second inclined face 133 so that the side retainer 25 can climb over the partition wall 119 while bending. As a result, the side retainer 25 moves from the temporary locking position to the final locking position.

On the other hand, a side face of the groove formation protrusion 129 on the temporary locking groove 123 side and a side face of the partition wall 119 on the final locking groove 121 side are vertical faces 135 and 137. Due to the vertical faces 135 and 137, movement of the side retainer 25 from the final locking position to the temporary locking position or removal of the side retainer 25 from the temporary locking position cannot be performed easily when the side retainer 25 is simply pulled in a removal direction (an opposite direction to the mounting direction).

The partition wall 119 is shorter than the retainer protrusion 117. On a front end side of the locking groove group 125, the partition wall 119 is partially absent so that the final locking groove 121 and the temporary locking groove 123 communicate with each other at the same groove depth. Incidentally, the partition wall 119 on the front end side of the locking groove group 125 may be formed to be lower in height than any of other regions (a central portion and a rear end portion).

The side retainer 25 which has been set at the temporary locking position allows the female terminals 17 to be inserted into the female terminal reception chambers 45, and locks the inserted female terminals 17 to prohibit the female terminals 17 from being removed. On the other hand, the side retainer 25 which has been set at the final locking position prohibits the female terminals 17 both from being inserted into the female terminal reception chambers 45 and from being removed from the female terminal reception chambers 45.

(CPA 21)

The CPA 21 is made of a synthetic resin. The CPA 21 is put on the female housing 13 from the rear so as to be mounted on the female housing 13 to be slidable in the fitting direction. A pair of left and right side walls 87 and a support wall 89 are formed in the CPA 21. The left and right side walls 87 rising up at an interval therebetween in the width direction are opposed to each other outside the female housing 13. The support wall 89 bridges upper end portions of the side walls 87. A CPA upper arm 91 is formed in a central portion of the support wall 89. The CPA upper arm 91 extends toward the male housing 15. A pair of left and right ridge portions 79 guided by the left and right guide grooves 67 of the female housing 13 respectively are provided protrusively on inner faces of rear portions of the left and right side walls 87 (see FIG. 16). Rear ends of the left and right side walls 87 are coupled by a flat plate-like CPA bridge (coupling portion) 81 serving for securing rigidity of the CPA 21.

Figure 16:
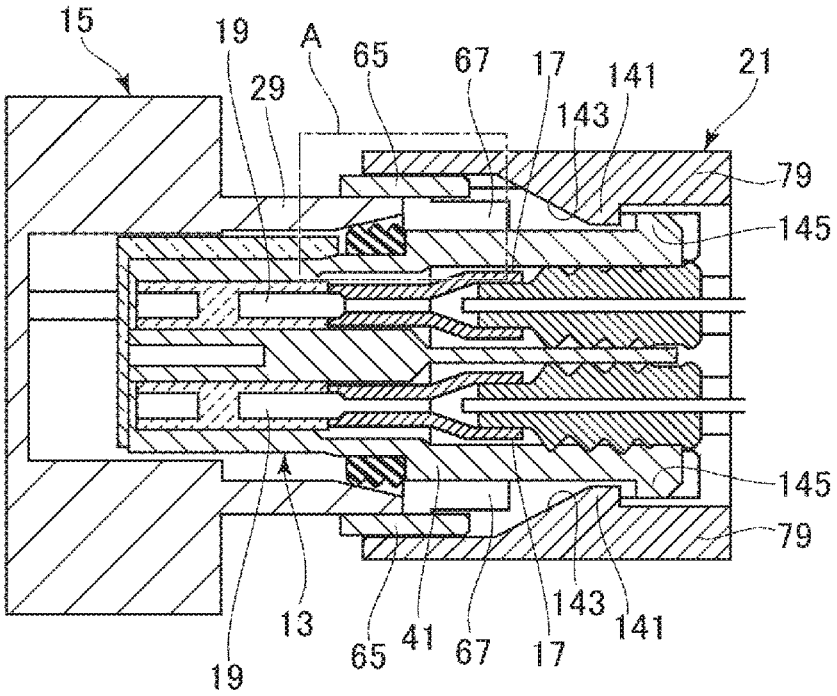
FIG. 16 is a cross-sectional view prior to the connector fitting.
Figure 17:
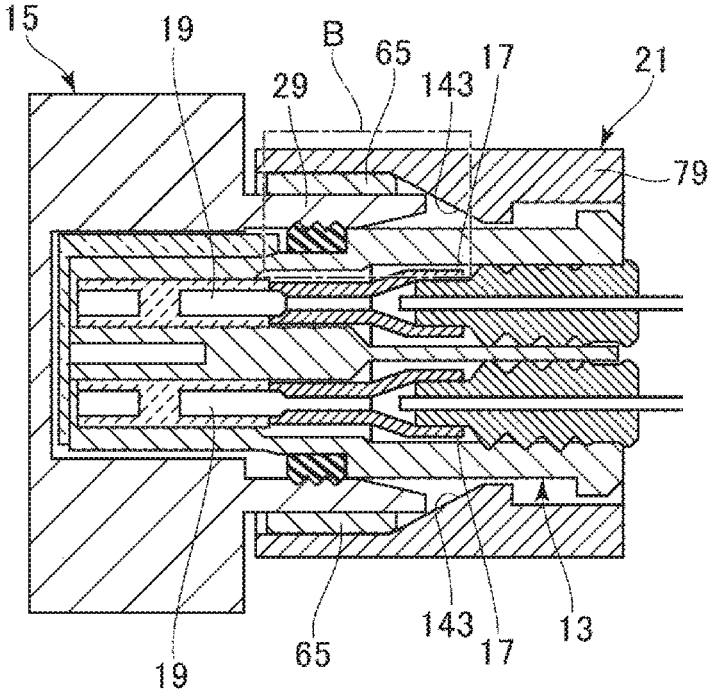
FIG. 17 is a cross-sectional view of the CPA final locking state.
Figure 18A:
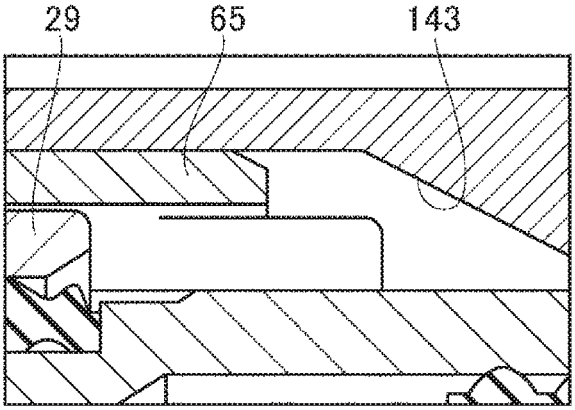
FIG. 18A is an enlarged view of a portion A of FIG. 16.
Figure 18B:
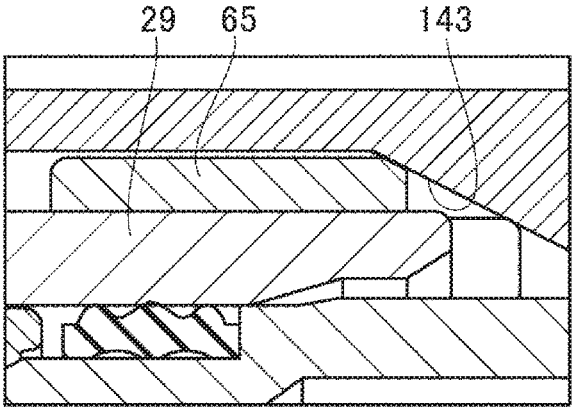
FIG. 18B is an enlarged view of a portion B of FIG. 17.

As shown in FIG. 16, a detachment prevention protrusion 141 protruding inward is provided in each of the ridge portions 79. A guide face 143 inclined outward and frontward is formed in a front portion of the detachment prevention protrusion 141. A pair of left and right stopper protrusions 145 protruding outward are formed in a rear end of the inner housing 41.

The CPA upper arm 91 is supported like a cantilever on the support wall 89. The CPA upper arm 91 is provided to tilt downward and toward the hood portion 29 of the male housing 15. An upper locking claw 93 extending downward is formed in a distal end portion of the CPA upper arm 91. An inclined face 95 is formed in a front face of a lower portion of the upper locking claw 93. While a rear end portion of the CPA upper arm 91 is used as a fulcrum, the upper locking claw 93 of the CPA upper arm 91 can swing upward (outward) to be elastically deformed (deflected). In the present embodiment, when the CPA 21 is mounted on the female housing 13, the upper locking claw 93 (the inclined face 95) of the CPA upper arm 91 climbs over the unlocking operation portion 59 of the locking arm 57 to abut against a rear end portion of the locking piece 55 of the housing arm 51. When both the housings 13 and 15 are fitted to each other, the upper locking claw 93 of the CPA upper arm 91 presses the rear end portion of the locking piece 55 in the fitting direction (frontward).

The CPA 21 has a CPA lower arm 99 which is supported like a cantilever at a position opposed to the CPA upper arm 91 (a position separated by about 180 degrees) and which extends toward the male housing 15. A lower locking claw 101 extending inward of the CPA 21 is formed in a distal end portion of the CPA lower arm 99. An inclined face 103 is formed in a front face of an upper portion of the lower locking claw 101. While a rear end portion of the CPA lower arm 99 is used as a fulcrum, the lower locking claw 101 of the CPA lower arm 99 can swing downward (outward) to be elastically deformed (deflected) in a similar manner to or the same manner as the CPA upper arm 91.

(Fitting Procedure of Connector 11)

Next, while a fitting procedure of the connector 11 according to the present embodiment is described, the remaining configuration of the aforementioned connector 11 will be described. Movement of the connector 11 when the female housing 13 has been brought close to the male housing 15 directly linked to the device wall of the electrical device will be described below by way of example.

First, the seal member 23 is mounted on the female housing 13, and the side retainer 25 is mounted at the temporary locking position of the inner housing front portion 44 overhanging from the outer housing 43. Successively, the female terminals 17 to which the electric wires 18 have been connected from the rear are inserted into the female terminal reception chambers 45 of the female housing 13, and the side retainer 25 is slid to the final locking position (regular position). Thus, the female terminals 17 are locked to the side retainer 25 to be thereby prevented from dropping off.

Next, the CPA 21 is mounted on the female housing 13 from the rear. On this occasion, the pair of ridge portions 79 of the CPA 21 are guided by the guide grooves 67. When the stopper protrusions 145 climb over the guide faces 143 to reach the temporary locking position (CPA temporary locking position) at the rear of the detachment prevention protrusions 141, the CPA 21 is locked to the female housing 13 (CPA temporary locking) to be thereby prevented from dropping off. In addition, the CPA upper arm 91 climbs over the unlocking operation portion 59 of the female housing 13 to move inward of the housing arm 51 to abut against the rear end face of the locking piece 55. Since the CPA upper arm 91 abuts against the locking piece 55 thus, the CPA 21 can push the male housing 15 in the fitting direction. Accordingly, positional accuracy between the CPA 21 and the female housing 13 during the fitting can be enhanced so that assembling workability can be improved.

When the CPA 21 is moved frontward relatively to the female housing 13, the CPA upper arm 91 abuts against the locking piece 55. Thus, the female housing 13 moves frontward together with the CPA 21. On the contrary, when the CPA 21 is moved rearward relatively to the female housing 13, the stopper protrusions 145 are locked to the detachment prevention protrusions 141. Thus, the female housing 13 moves rearward together with the CPA 21.

When the female housing 13 in the CPA temporary locking state is aligned with the male housing 15 and the CPA 21 is pushed in the fitting direction (frontward), the inner housing 41 of the female housing 13 is inserted into the hood portion 29 of the male housing 15 so that distal end portions of the male terminals 19 are inserted into the insertion ports 47. At this stage, both the housing arm 51 and the CPA upper arm 91 are separated from the upper locking protrusion 33 and deflection does not occur. In addition, the CPA lower arm 99 is also separated from the lower locking protrusion 34 and deflection does not occur.

When the CPA 21 is further pushed in the fitting direction, the locking piece 55 of the housing arm 51 reaches the upper inclined face 35 of the upper locking protrusion 33 to ride thereon, and then starts sliding on the upper inclined face 35 while being elastically deformed upward (in the opposite direction to the locking direction), as shown in FIG. 4. The locking piece 55 of the housing arm 51 is pressed against the upper inclined face 35 so as to be elastically deformed upward. Thus, restoring force of the housing arm 51 acts on the upper inclined face 35, so that the male housing 15 is urged in an opposite direction to the fitting direction by the female housing 13, and the female housing 13 receives reaction from the male housing 15. As a result, when a hand holding the CPA 21 is released, the female housing 13 is pushed back in the opposite direction to the fitting direction together with the CPA 21. Incidentally, in the state of FIG. 4, the CPA lower arm 99 is separated from the lower locking protrusion 34 and deflection does not occur.

Figure 5:
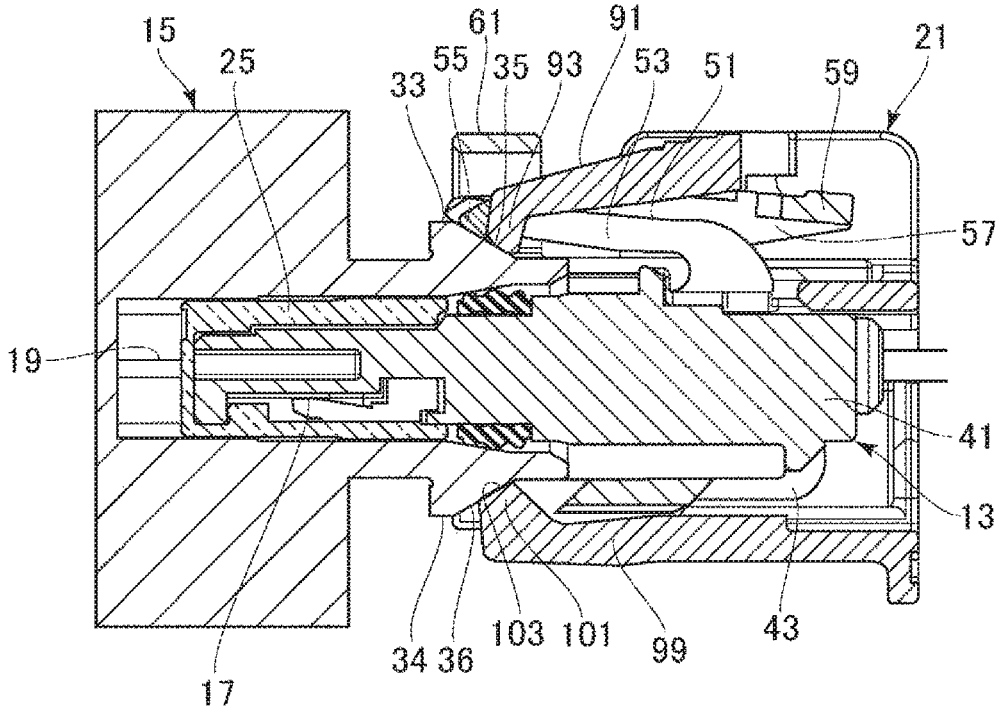
FIG. 5 is a longitudinal sectional view halfway through the connector fitting.

When the CPA 21 is further pushed in the fitting direction from the state of FIG. 4, the upper locking claw 93 of the CPA upper arm 91 reaches the upper inclined face 35 of the upper locking protrusion 33 to ride thereon, and then starts sliding on the upper inclined face 35, as shown in FIG. 5. The upper locking claw 93 of the CPA upper arm 91 is pressed against the upper inclined face 35 so as to be elastically deformed upward. Thus, recovering force of the CPA upper arm 91 acts on the upper inclined face 35, the male housing 15 is urged in the opposite direction to the fitting direction by the CPA 21, and the CPA 21 receives reaction from the male housing 15. In addition, at a time point when the upper locking claw 93 of the CPA upper arm 91 has started sliding on the upper inclined face 35 of the upper locking protrusion 33, the locking piece 55 of the housing arm 51 is also still sliding on the upper inclined face 35 so that the female housing 13 also receives reaction from the upper inclined face 35 due to the elastic deformation of the locking piece 55. Further, at substantially the same timing as when the upper locking claw 93 of the CPA upper arm 91 starts sliding on the upper inclined face 35, the lower locking claw 101 of the CPA lower arm 99 starts sliding on the lower inclined face 36 of the lower locking protrusion 34. The lower locking claw 101 of the CPA lower arm 99 is pressed against the lower inclined face 36 so as to be elastically deformed downward. Thus, restoring force of the CPA lower arm 99 acts on the lower inclined face 36, the male housing 15 is urged in the opposite direction to the fitting direction by the CPA 21, and the CPA 21 receives reaction from the male housing 15.

Figure 6:
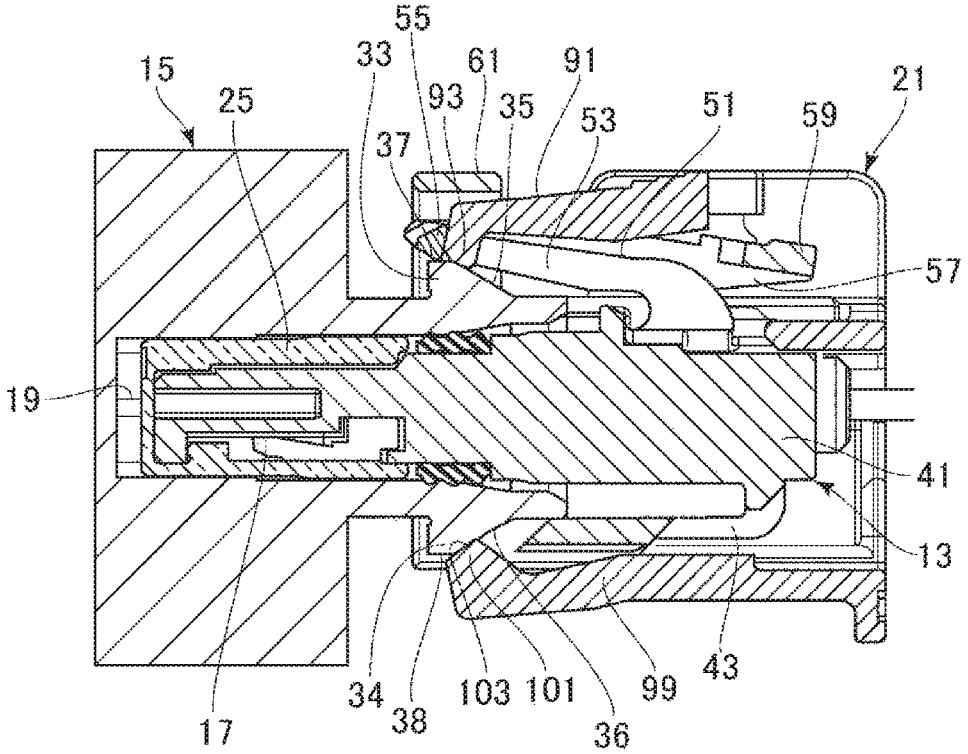
FIG. 6 is a longitudinal sectional view halfway through the connector fitting.

When the CPA 21 is further pushed in the fitting direction from the state of FIG. 5, the locking piece 55 of the housing arm 51 climbs over the upper inclined face 35 to reach the upper flat face 37, as shown in FIG. 6. Thus, the restoring force of the housing arm 51 ceases to act on the upper inclined face 35 so that the housing arm 51 cannot push the male housing 15 back anymore.

In this respect in the present embodiment, the upper locking claw 93 of the CPA upper arm 91 is set to be still positioned at the upper inclined face 35 at a time point when the locking piece 55 has ridden on the upper flat face 37. Accordingly, the CPA 21 receives reaction from the upper inclined face 35 due to the elastic deformation of the upper locking claw 93. In a similar manner or the same manner, the lower locking claw 101 of the CPA lower arm 99 is also set to be still positioned at the lower inclined face 36 at a time point when the locking piece 55 has ridden on the upper flat face 37. Accordingly, the CPA 21 also receives reaction from the lower inclined face 36 due to the elastic deformation of the lower locking claw 101.

When the CPA 21 is further pushed in the fitting direction from the state of FIG. 6, the upper locking claw 93 continuously slides on the upper inclined face 35 and the lower locking claw 101 continuously slides on the lower inclined face 36 while the locking piece 55 moves on the upper flat face 37.

Figure 7:
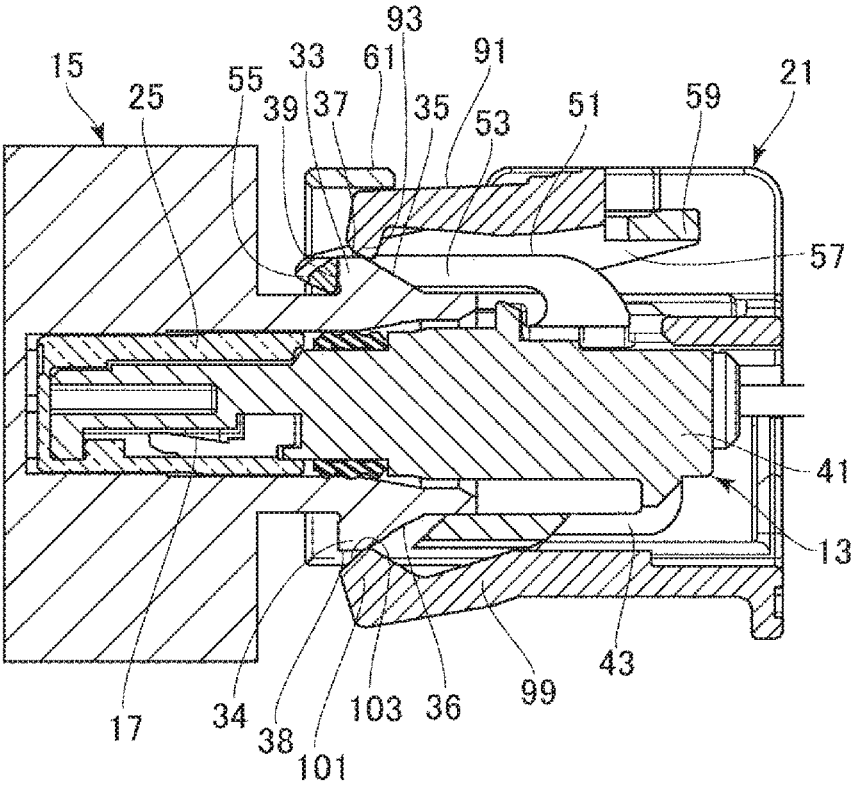
FIG. 7 is a longitudinal sectional view of a connector fitting state.

As soon as the locking piece 55 passes through the upper flat face 37, the locking piece 55 is elastically restored downward (in the locking direction) to be locked to the upper locking face 39 of the upper locking protrusion 33 so that the two housings 13 and 15 are brought into a locking state to each other (a connector fitting state), as shown in FIG. 7. At a time point when the fitting has been completed, the upper locking claw 93 of the CPA upper arm 91 is still positioned at the upper inclined face 35 and the lower locking claw 101 of the CPA lower arm 99 is also positioned at the lower inclined face 36. Accordingly, the CPA 21 continues to receive the reaction from the upper inclined face 35 due to the elastic deformation of the upper locking claw 93 and the reaction from the lower inclined face 36 due to the elastic deformation of the lower locking claw 101.

Figure 8:
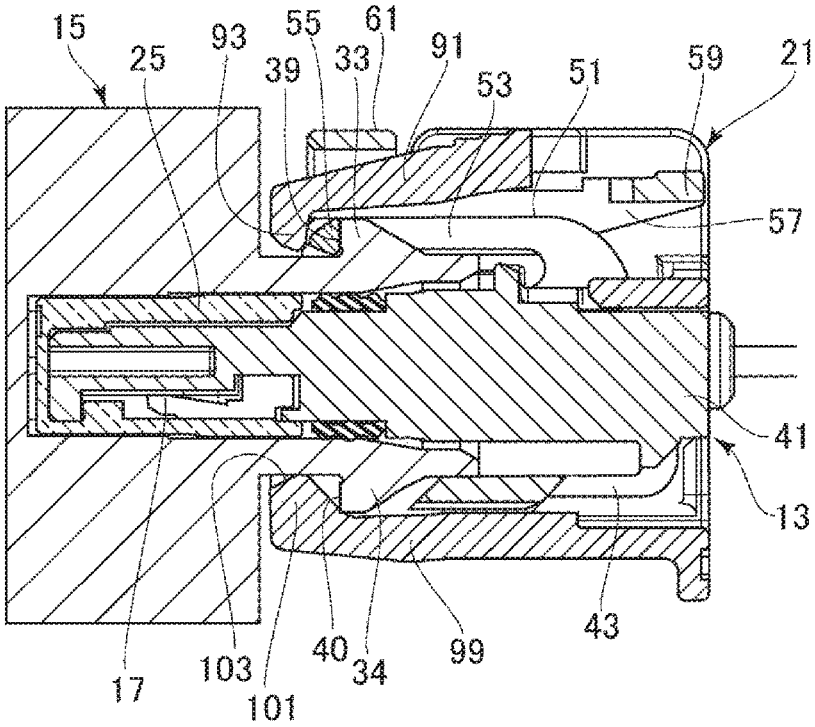
FIG. 8 is a longitudinal sectional view of the CPA final locking state.

Successively, the upper locking claw 93 passes through the upper flat face 37 and climbs over the locking piece 55 which has been locked to the upper locking protrusion 33. Then, the upper locking claw 93 is elastically restored to be locked to the upper locking face 39 at a posture where the locking piece 55 is held between the upper locking claw 93 and the upper locking protrusion 33 (CPA final locking), as shown in FIG. 8. Thus, since the two housings 13 and 15 are always brought into the locking state in a state in which the CPA upper arm 91 has been locked to the upper locking protrusion 33 (a state in which the CPA 21 has been set at the CPA final locking position), the fitting between the two housings 13 and 15 is assured by the fitting of the CPA upper arm 91 (the CPA final locking). In addition, since the locking piece 55 is held between the upper locking protrusion 33 and the upper locking claw 93, the female housing 13 can be restrained from being detached. Incidentally, after the lower locking claw 101 has passed through the lower flat face 38, the lower locking claw 101 is elastically restored to be locked to the lower locking protrusion 34 at substantially the same timing as when the upper locking claw 93 is locked.

Thus, in the present embodiment, the upper locking claw 93 of the CPA upper arm 91 starts sliding on the upper inclined face 35 before the female housing 13 and the male housing 15 are fitted to each other. The upper locking claw 93 of the CPA upper arm 91 is positioned on the upper inclined face 35 until the female housing 13 and the male housing 15 are fitted to each other. The upper locking claw 93 on the upper inclined face 35 receives reaction force from the upper inclined face 35, and a component of the reaction force acts on the CPA 21 as repulsive force against the connector fitting. Accordingly, the repulsive force generated by the upper locking claw 93 (the CPA upper arm 91) can be made to act until immediately before the fitting so that half-fitting can be prevented.

In addition, the locking piece 55 on the upper inclined face 35 receives the reaction force from the upper inclined face 35 and a component of the reaction force acts on the female housing 13 as repulsive force against the connector fitting. Accordingly, of an entire region of a fitting stroke between when the locking piece 55 starts sliding on the upper inclined face 35 and when the locking piece 55 is locked to the upper locking protrusion 33, in a first half up to when the upper locking claw 93 starts sliding on the upper inclined face 35, the repulsive force caused by the locking piece 55 acts. In a second half of the fitting stroke between when the upper locking piece 93 starts sliding on the upper inclined face 35 and when the locking piece 55 rides onto the upper flat face (top face) 37 of the upper locking protrusion 33, the repulsive force caused by the locking piece 55 and the repulsive force caused by the upper locking claw 93 act. Immediately before the fitting until the locking piece 55 is locked to the upper locking protrusion 33 after riding onto the upper flat face 37 of the upper locking protrusion 33, the repulsive force caused by the upper locking claw 93 acts. That is, the repulsive forces can be made to act in the entire region of the fitting stroke.

Further, the repulsive force caused by the locking piece 55, the repulsive force caused by the upper locking claw 93, and the repulsive force caused by the lower locking claw 101 act while the lower locking claw 101 is positioned on the lower inclined face 36 in the second half of the fitting stoke. The repulsive force caused by the upper locking claw 93 and the repulsive force caused by the lower locking claw 101 act immediately before the fitting. Accordingly, the repulsive forces against the fitting can be enhanced.

In addition, a lock portion where the locking piece 55 and the upper locking claw 93 are locked to the upper locking protrusion 33 is covered with the female housing bridge 61 from the outside. Accordingly, it is possible to prevent the connector fitting from being unintendedly released by external force acting on the lock portion. In addition, the female housing bridge 61 is disposed outside and near the movable range of the locking piece 55. Accordingly, excessive displacement of the locking piece 55 (excessive deformation of the housing arm 51) can be suppressed by the female housing bridge 61 so that damage of the female housing 13 can be prevented.

(Fitting Release Procedure of Connector 11)

Next, a fitting release procedure of the connector 11 will be described with reference to FIG. 9 to FIG. 13.

Figure 9:
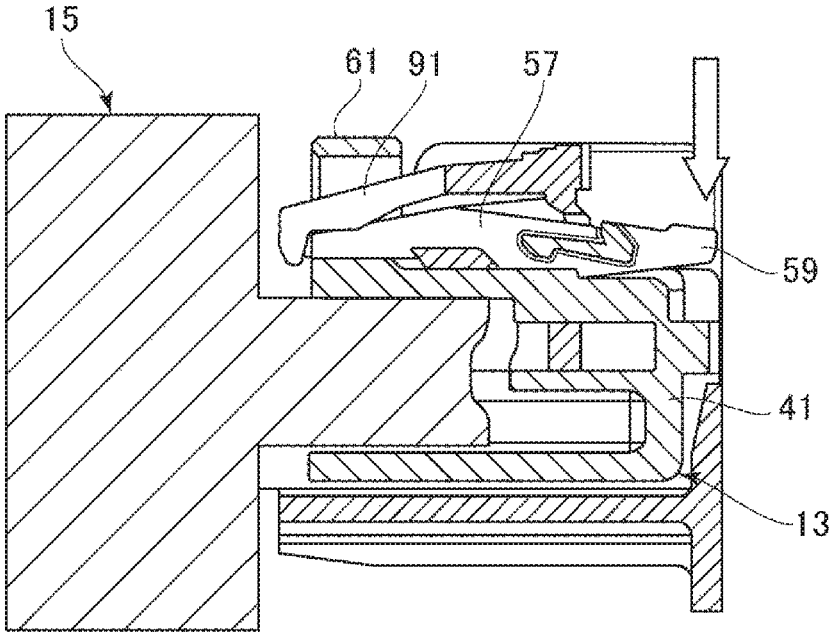
FIG. 9 is a longitudinal sectional view during release of the connector fitting (CPA final locking).

In the CPA final locking state, the upper locking claw 93 of the CPA upper arm 91 is locked to the upper locking protrusion 33 of the male housing 15 through the locking piece 55 of the housing arm 51, as shown in FIG. 9. To release the fitting in the connector 11, first, the CPA 21 is moved from the final locking position to the temporary locking position. To move the CPA 21 from the final locking position to the temporary locking position, the CPA 21 is pulled rearward (in the opposite direction to the fitting direction) while the unlocking operation portion 59 is pushed down in an unlocking operation direction. By pushing down the unlocking operation portion 59, release auxiliary force acts upward (in the opposite direction to the locking direction) on the CPA upper arm 91 from a front end portion of the locking arm 57 (the locking piece 55 of the housing arm 51). By the release auxiliary force, pulling force applied to the CPA 21, and respective inclined faces of the locking piece 55 and the upper locking claw 93, the upper locking claw 93 climbs over the locking piece 55 to ride onto the upper locking protrusion 33, and consequently, the CPA 21 reaches the CPA temporary locking position, as shown in FIG. 10.

Figure 11:
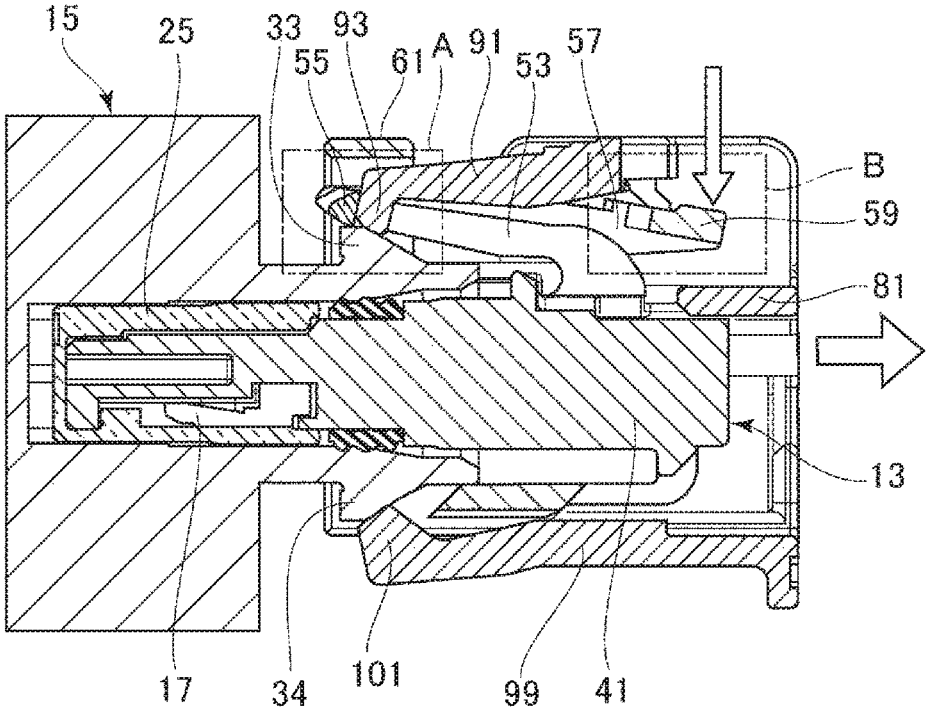
FIG. 11 is a longitudinal sectional view during the release of the connector fitting (CPA temporary locking).
Figure 12:
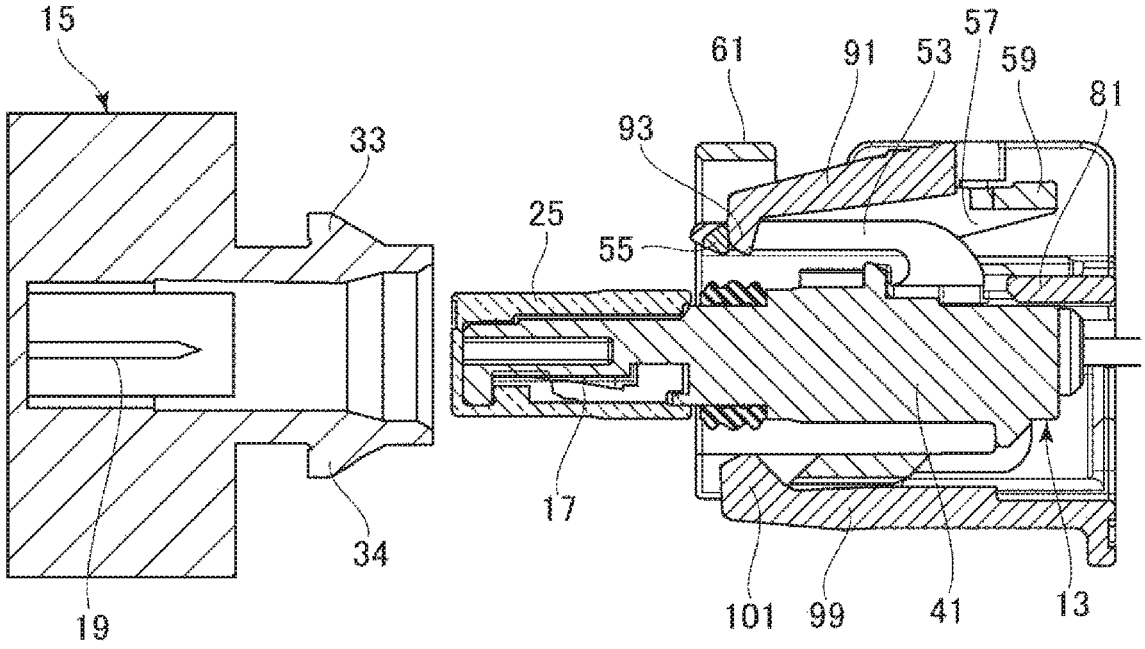
FIG. 12 is a longitudinal sectional view after the release of the connector fitting (CPA temporary locking).
Figure 13A:
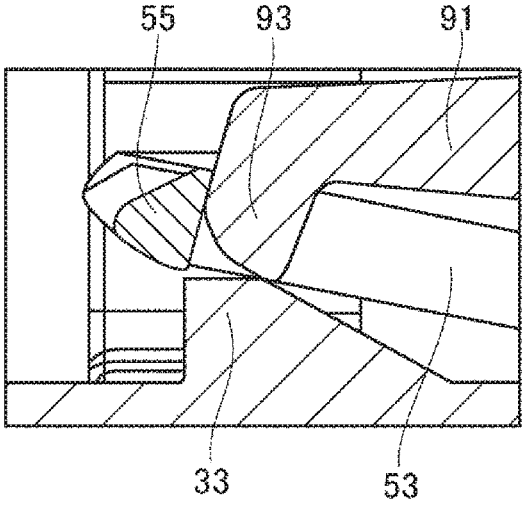
FIG. 13A is an enlarged view of a portion A of FIG. 11.
Figure 13B:
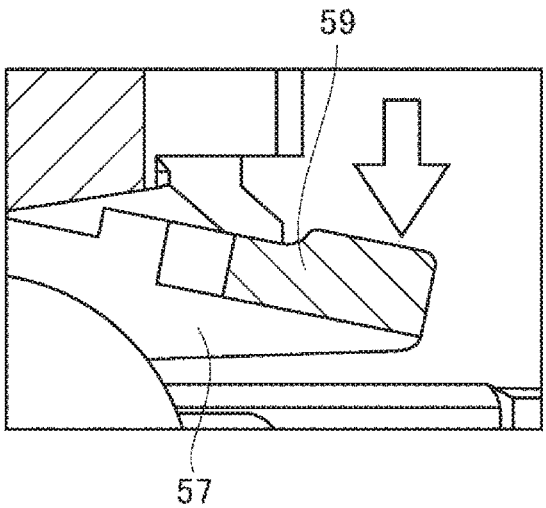
FIG. 13B is an enlarged view of a portion B of FIG. 11.

Successively, the connector fitting state is released. To release the connector fitting state, the CPA 21 is further pulled rearward while the unlocking operation portion 59 is pushed down in the unlocking operation direction. By pushing down the unlocking operation portion 59, the unlocking force acting upward (in the opposite direction to the locking direction) is applied to the locking piece 55. As shown in FIG. 11 and FIG. 13A, the locking piece 55 rides onto the upper locking protrusion 33 by the unlocking force and the pulling force applied to the CPA 21 (release of the connector fitting). The upper locking claw 93 and the locking piece 55 sequentially climb over the upper locking protrusion 33. As a result, the female housing 13 is removed from the male housing 15, as shown in FIG. 12. Incidentally, in order to surely retain the connector fitting state, inclined faces for assisting the unlocking, like the opposed faces of the locking piece 55 and the upper locking claw 93 (a front face of the locking piece 55 and a rear face of the upper locking claw 93), are not provided in opposed faces of the locking piece 55 and the upper locking protrusion 33 (a rear face of the locking piece 55 and a front face of the upper locking protrusion 33).

(Prevention of Excessive Displacement of Unlocking Operation Portion 59 and Suppression of Increase in Whole Size of Connector 11)

Figure 10:
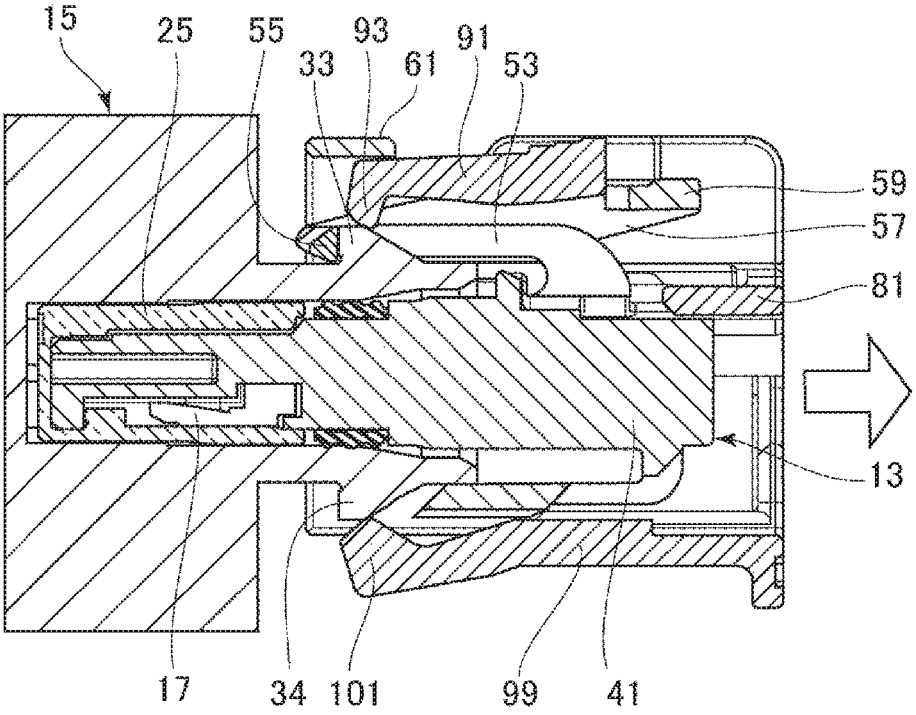
FIG. 10 is a longitudinal sectional view during the release of the connector fitting (CPA temporary locking).
Figure 14:
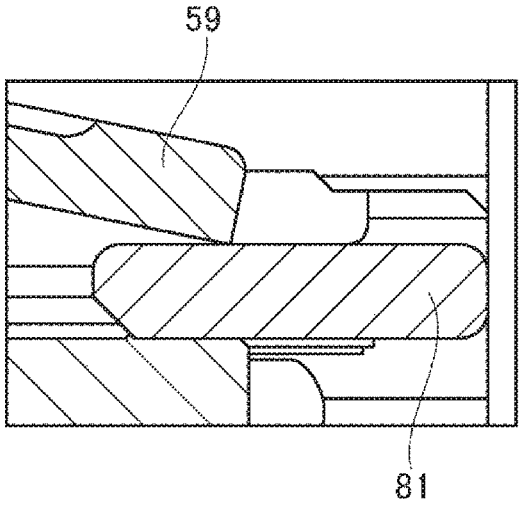
FIG. 14 is an enlarged view showing a state in which excessive displacement of a fitting release portion is prevented by a CPA bridge.

As shown in FIG. 10 and FIG. 11, in the CPA temporary locking in which the CPA 21 has been set at the CPA temporary locking position, the CPA bridge 81 is positioned between the unlocking operation portion 59 and the female housing 13 (the inner housing 41) and separately from the unlocking operation portion 59. The CPA bridge 81 then abuts against the unlocking operation portion 59 within a range in which displacement of the unlocking operation portion 59 in the unlocking operation direction cannot be excessive (see FIG. 14). Accordingly, excessive displacement of the unlocking operation portion 59 (excessive deformation of the locking arm 57) can be prevented by the CPA bridge 81 so that damage of the female housing 13 can be prevented.

Incidentally, in the present embodiment, also in the CPA final locking, the CPA bridge 81 is positioned between the unlocking operation portion 59 and the female housing 13 (the inner housing 41) and separately from the unlocking operation portion 59 in a similar manner to or the same manner as the CPA temporary locking so as to prevent excessive displacement of the unlocking operation portion 59.

In addition, in a connector using state, the CPA 21 is set at the CPA final locking position to which the CPA 21 has moved frontward from the CPA temporary locking position. In the CPA final locking, a rear end (a distal end on the opposite side to the fitting side) of the CPA bridge 81 is positioned more frontward (on the fitting side) than a rear end of the female housing 13. An almost entire region of the CPA bridge 81 is disposed more frontward than a rear end of the unlocking operation portion 59 (see FIG. 8). Accordingly, an increase in the whole size of the connector 11 in the connector using state can be suppressed.

(Prevention of Tilt of Female Housing 13 by CPA Bridge 81)

In the CPA final locking as shown in FIG. 8, the CPA bridge 81 abuts against an upper face of the female housing 13 (the inner housing 41) so as to restrict tilt of the female housing 13 with respect to the CPA 21. Thus, in the connector using state (the CPA final locking), the tilt of the female housing 13 with respect to the CPA 21 can be restricted. Accordingly, a connection state between the female terminals 17 received in the female housing 13 and the male terminals 19 received in the male housing 15 can be stabilized.

(Prevention of Looseness of Female Housing 13 by Side Locks 65)

As shown in FIG. 15 to FIG. 18, a pair of left and right side locks 65 are formed in the outer housing 43, and the hood portion 29 of the male housing 15 fitted to the female housing 13 is inserted between and inside the side locks 65 so as to restrict inward displacement of the side locks 65. When the CPA 21 makes sliding movement from the temporary locking state to the final locking state, the guide faces 143 of the detachment prevention protrusions 141 of the CPA 21 press the side locks 65 inward. As a result, the side locks 65 are held between the guide faces 143 and the hood portion 29. In addition, relative movement along the fitting direction between the female housing 13 and the CPA 21 is restricted in the CPA temporary locking, and the CPA 21 can make sliding movement from the temporary locking state to the final locking state due to the connector fitting. That is, due to the fitting between the female housing 13 and the male housing 15, the CPA 21 is allowed to make sliding movement to the position in which the guide faces 143 of the detachment prevention protrusions 141 can press the side locks 65.

Thus, in the connector fitting state, the female housing 13 can be prevented from getting loose relatively to the male housing 15 and the CPA 21 by the side locks 65. In addition, the timing when the guide faces 143 press the side locks 65 is after the connector fitting. Accordingly, the guide faces 143 can easily press the side locks 65 by inertial force during the connector fitting so that the side locks 65 can be held between the guide faces 143 and the hood portion 29. Thus, an insertion feeling during the connector fitting can be prevented from being impaired.

(Movement of Side Retainer 25 from Final Locking Position to Temporary Locking Position)

Figure 22:
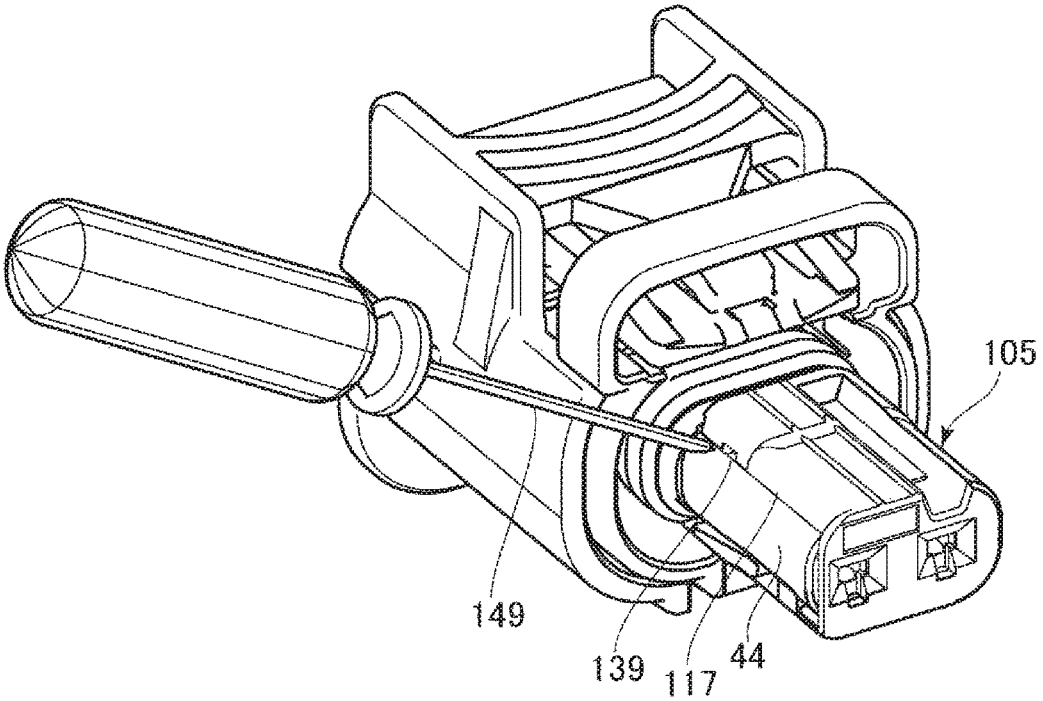
FIG. 22 is a perspective view of a state before the side retainer is moved by a jig.
Figure 23:
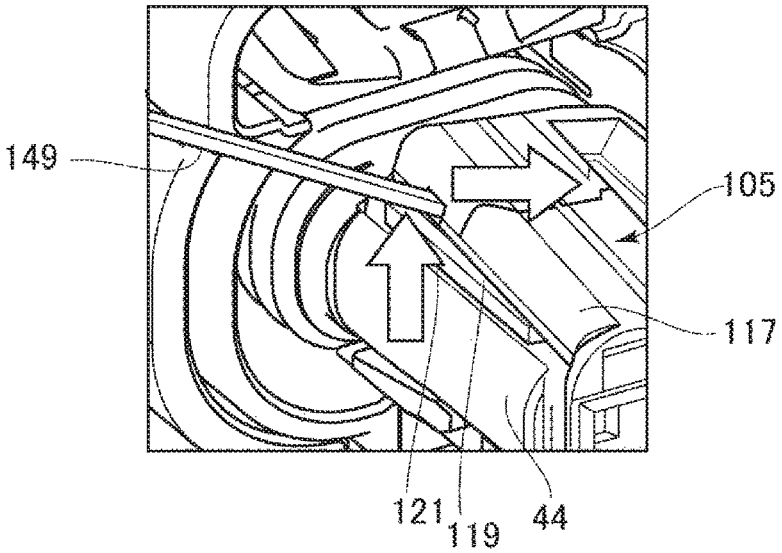
FIG. 23 is a perspective view when the side retainer is being moved by the jig.

As described above, the side retainer 25 cannot be moved from the final locking position to the temporary locking position even when the side retainer 25 is simply pulled in the removal direction. Therefore, when the side retainer 25 is moved from the final locking position to the temporary locking position, a distal end of the jig 149 is inserted into the notch 139 of the retainer protrusion 117, and the side retainer 25 is lifted up and moved relatively to the inner housing front portion 44 by the jig 149, as shown in FIG. 22 and FIG. 23.

Figure 24:
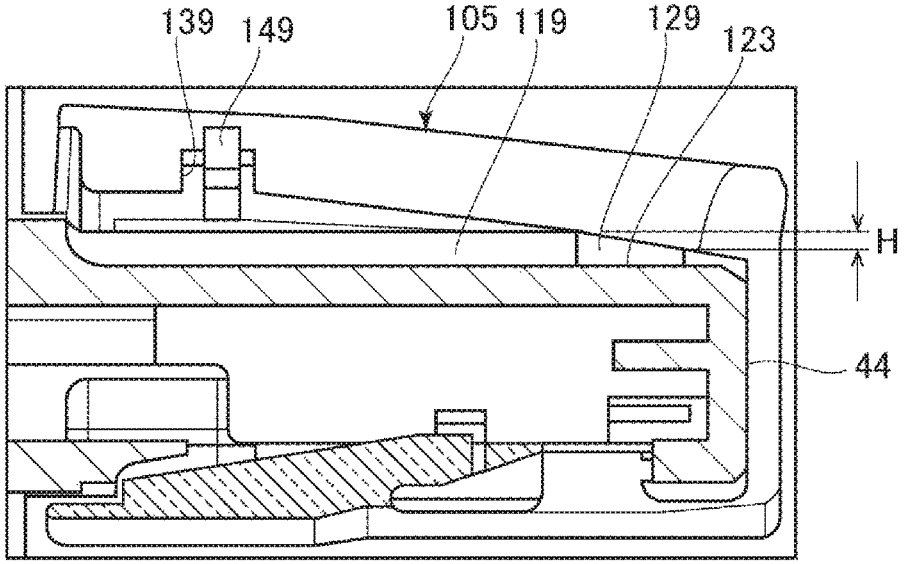
FIG. 24 is a longitudinal sectional view of the side retainer which is being moved.

Here, the partition wall 119 is partially absent on the front side which is an opposite side to the notch 139. Accordingly, lifting height of the retainer protrusion 117 required for moving the side retainer 25 from the final locking groove 121 to the temporary locking groove 123 is lower on the front side than at a central portion. When the side retainer 25 is moved from the final locking groove 121 to the temporary locking groove 123, a front end of the retainer protrusion 117 moves more easily on a groove bottom side (lower side) than in an open end (upper end) of the temporary locking groove 123. For example, when the retainer protrusion 117 climbs over the partition wall 119 at a lowest position, a difference H occurs between the upper end of the temporary locking groove 123 and the front end of the retainer protrusion 117, as shown in FIG. 24. Even when the front end of the retainer protrusion 117 moves to a position lower than the upper end of the temporary locking groove 123, the retainer protrusion 117 still can move from the final locking position. Accordingly, when the side retainer 25 is moved from the final locking groove to the temporary locking groove, it is difficult for the front side of the retainer protrusion 117 to pass through the temporary locking groove 123 so that the side retainer 25 can be restrained from being detached from the inner housing front portion 44 due to unintended unlocking.

Although the embodiments of the present invention have been described above in detail based on the drawings, the aforementioned embodiments are merely examples of the present invention and any change or modification can be made thereon within the scope of the invention.

For example, an example in which the upper locking claw 93 of the CPA upper arm 91 is locked to the upper locking protrusion 33 through the locking piece 55 of the housing arm 51 has been described in the aforementioned embodiments. However, the present invention is not limited to this example. For example, configuration may be made so that the locking piece 55 and the upper locking claw 93 are locked to different locking faces from each other.

Here, the aforementioned characteristics of the embodiment of the connector according to the present invention are briefly summarized and listed in the following [1] and [2] respectively.

[1] A connector comprising:

a housing (13); and a fitting assurance member (21) slidably attached to an outer side of the housing (13) to enable a sliding movement, the housing (13) having a locking portion (55) being elastically deformed in an opposite direction to a locking direction to climb over a locked portion (33) of a counterpart housing (15) and elastically restored in the locking direction to be locked to the locked portion (33) upon a movement of the housing (13) in a fitting direction to the counterpart housing (15), the fitting assurance member (21) sliding and moving relatively to the housing (13) in the fitting direction from a temporary locking position to a formal locking position to be locked to the counterpart housing (15) upon the locking portion (55) being locked to the locked portion (33) to achieve a connector fitting state, the housing (13) having an unlocking operation portion (59) to be separated outward from an opposite fitting side of the housing (13), the unlocking operation portion (59) being pushed down in an unlocking operation direction toward the housing (13) to apply unlocking force to the locking portion (55) in the opposite direction, the unlocking operation portion (59) being pushed down in the unlocking operation direction upon the fitting assurance member (21) being positioned at the temporary locking position to release the connector fitting state, the fitting assurance member (21) having a pair of side walls opposed to each other on the outer side of the housing (13) and a coupling portion (81) connecting end portions of the pair of side walls on the opposite fitting side each other, the coupling portion (81) being located between the unlocking operation portion (59) and the housing (13) and separated from the unlocking operation portion (59) upon the fitting assurance member (21) being positioned at the temporary locking position, the coupling portion (81) being configured to allow contact to the unlocking operation portion (59) upon the unlocking operation portion (59) being pushed down and displaced in the unlocking operation direction.

[2] The connector according to the item [1], wherein the coupling portion (81) of the fitting assurance member (21) positioned at the temporary locking position contacts to the housing (13) to restrict a tilt of the housing (13) with respect to the fitting assurance member (21).

The connector according to the present invention can suppress an increase in the size of the connector while securing rigidity of the fitting assurance member (CPA). The present invention having the effect can be, for example, used for a connector structure including a fitting assurance member.

REFERENCE SIGNS LIST

11 connector
12 female connector unit
13 female housing (housing)
15 male housing (counterpart housing)
17 female terminal
19 male terminal
21 CPA (fitting assurance member)
25 side retainer
33 upper locking protrusion (locked portion)
34 lower locking protrusion
35 upper inclined face
36 lower inclined face
37 upper flat face
38 lower flat face
44 inner housing front portion
51 housing arm
53 elastic arm piece
55 locking piece (locking portion)
59 unlocking operation portion
61 female housing bridge
65 side lock
71 lock portion
81 CPA bridge (coupling portion)
87 side wall
91 CPA upper arm
93 upper locking claw

99 CPA lower arm
101 lower locking claw

The invention claimed is:

1. A connector comprising:

a housing; and a fitting assurance member slidably attached to an outer side of the housing to enable a sliding movement, the housing having a locking portion being elastically deformed in an opposite direction to a locking direction to climb over a locked portion of a counterpart housing and elastically restored in the locking direction to be locked to the locked portion upon a movement of the housing in a fitting direction to the counterpart housing, the fitting assurance member sliding and moving relatively to the housing in the fitting direction from a temporary locking position to a formal locking position to be locked to the counterpart housing upon the locking portion being locked to the locked portion to achieve a connector fitting state, the housing having an unlocking operation portion to be separated outward from an opposite fitting side of the housing, the unlocking operation portion being pushed down in an unlocking operation direction toward the housing to apply unlocking force to the locking portion in the opposite direction, the unlocking operation portion being pushed down in the unlocking operation direction upon the fitting assurance member being positioned at the temporary locking position to release the connector fitting state, the fitting assurance member having a pair of side walls opposed to each other on the outer side of the housing and a coupling portion connecting end portions of the pair of side walls on the opposite fitting side each other, the coupling portion being located between the unlocking operation portion and the housing and separated from the unlocking operation portion upon the fitting assurance member being positioned at the temporary locking position, the coupling portion being configured to allow contact to the unlocking operation portion upon the unlocking operation portion being pushed down and displaced in the unlocking operation direction.

2. The connector according to claim 1, wherein the coupling portion of the fitting assurance member positioned at the temporary locking position contacts to the housing to restrict a tilt of the housing with respect to the fitting assurance member.

* * * * *